US011326373B2

(12) United States Patent
Inan

(10) Patent No.: US 11,326,373 B2
(45) **Date of Patent: *May 10, 2022**

(54) MOTOR VEHICLE DOOR LOCK

(71) Applicant: Kiekert AG, Heiligenhaus (DE)

(72) Inventor: Ömer Inan, Dorsten (DE)

(73) Assignee: Kiekert AG, Heiligenhaus (DE)

( * ) Notice: Subject to any disclaimer, the term of this patent is extended or adjusted under 35 U.S.C. 154(b) by 804 days.

This patent is subject to a terminal disclaimer.

(21) Appl. No.: 15/553,611

(22) PCT Filed: Feb. 12, 2016

(86) PCT No.: PCT/DE2016/100063

§ 371 (c)(1),
(2) Date: Sep. 18, 2017

(87) PCT Pub. No.: WO2016/134696

PCT Pub. Date: Sep. 1, 2016

(65) Prior Publication Data

US 2018/0044952 A1 Feb. 15, 2018

(30) Foreign Application Priority Data

Feb. 25, 2015 (DE) ..... 10 2015 002 450.7

(51) Int. Cl.
*E05B 79/10* (2014.01)
*E05B 83/40* (2014.01)
(Continued)

(52) U.S. Cl.
CPC ..... *E05B 79/10* (2013.01); *E05B 63/143* (2013.01); *E05B 77/32* (2013.01); *E05B 83/38* (2013.01);
(Continued)

(58) Field of Classification Search
CPC ..... E05B 79/10; E05B 63/143; E05B 77/32; E05B 83/38; E05B 83/04; E05B 79/20;
(Continued)

(56) References Cited

U.S. PATENT DOCUMENTS 2,104,639 A * 1/1938 Dall ..... E05B 83/36 49/24
2,122,612 A * 7/1938 Knapp ..... E05B 77/46 292/33
(Continued)

FOREIGN PATENT DOCUMENTS

DE 10 2006 020 344 A1 10/2007
DE 102006019336 A1 10/2007
(Continued)

OTHER PUBLICATIONS

International Search Report and Written Opinion for corresponding Patent Application No. PCT/DE2016/100063 dated May 18, 2016.

*Primary Examiner* — Christine M Mills
*Assistant Examiner* — Faria F Ahmad
(74) *Attorney, Agent, or Firm* — Renner, Otto, Boisselle & Sklar, LLP

(57) ABSTRACT

The invention relates to a motor vehicle door lock (1) which comprises a locking mechanism having a rotary latch and at least one pawl, and a first actuating lever (8), the locking mechanism being at least indirectly unlockable by means of the actuating lever (8), and the locking mechanism further having a locking device (21). The actuating lever (8) can be disengaged from the locking mechanism by means of the locking device (21). An additional motor vehicle door lock (2) is provided, and said vehicle door lock (2) can be actuated by means of the actuating lever (8). The actuating lever chain to the additional motor vehicle lock (2) can be disengaged by means of the locking device (21).

7 Claims, 8 Drawing Sheets

Figure 1:
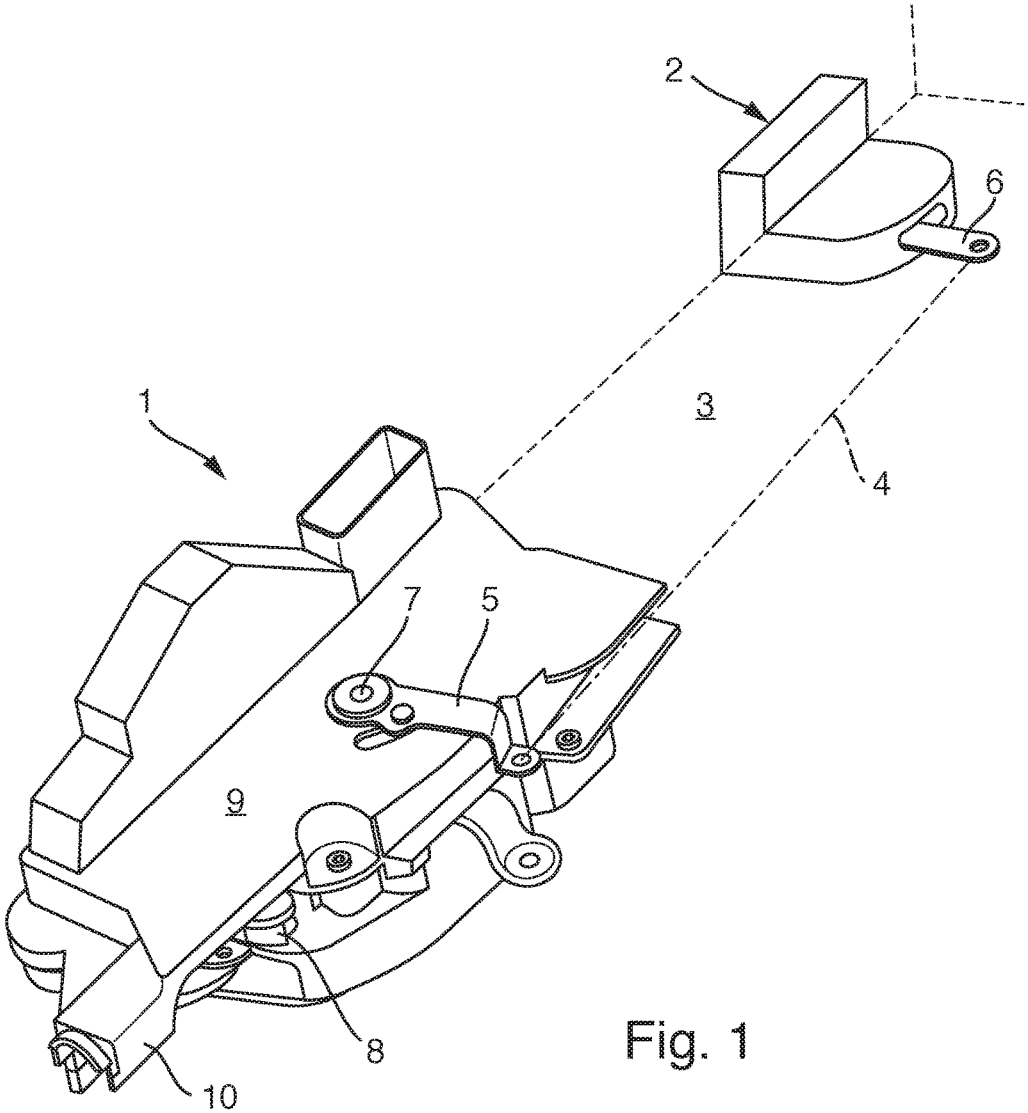

(51) Int. Cl.

| | |
|---|---|
| ***E05B 77/32*** | (2014.01) |
| ***E05B 83/38*** | (2014.01) |
| ***E05B 63/14*** | (2006.01) |
| ***E05B 81/06*** | (2014.01) |
| ***E05B 15/04*** | (2006.01) |
| ***E05B 81/36*** | (2014.01) |
| ***E05B 79/20*** | (2014.01) |

(52) U.S. Cl.
CPC ..... *E05B 83/40* (2013.01); *E05B 79/20* (2013.01); *E05B 81/06* (2013.01); *E05B 81/36* (2013.01); *E05B 2015/041* (2013.01); *E05B 2015/0468* (2013.01); *Y10S 292/03* (2013.01); *Y10S 292/23* (2013.01); *Y10S 292/46* (2013.01); *Y10T 292/08* (2015.04); *Y10T 292/1045* (2015.04); *Y10T 292/1047* (2015.04); *Y10T 292/1048* (2015.04); *Y10T 292/1082* (2015.04)

(58) Field of Classification Search
CPC .... E05B 81/06; E05B 81/36; E05B 2015/041; E05B 2015/0468; E05B 79/11; E05B 79/12; E05B 79/14; E05B 79/08; E05B 79/16; E05B 77/46; E05B 77/465; E05B 77/54; E05B 83/16; E05B 83/18; E05B 83/20; E05B 83/22; E05B 83/24; E05B 83/30; E05B 83/32; E05B 83/40; Y10T 292/1082; Y10T 292/1047; Y10T 292/0848; Y10T 292/0849; Y10T 292/0853; Y10T 292/0857; Y10T 292/1045; Y10T 292/1048; Y10T 292/08; Y10S 292/23; Y10S 292/43
See application file for complete search history.

(56) References Cited

U.S. PATENT DOCUMENTS

| | | | | | |
|---|---|---|---|---|---|
| 2,344,826 | A * | 3/1944 | Le Gresley | E05B 77/54 | 292/33 |
| 2,497,485 | A * | 2/1950 | Yost | E05B 77/46 | 292/38 |
| 2,507,822 | A * | 5/1950 | Sherrill | E05B 77/46 | 292/5 |
| 2,519,197 | A * | 8/1950 | Preston | E05B 77/48 | 292/144 |
| 2,612,397 | A * | 9/1952 | Stutt | E05B 79/20 | 292/166 |
| 2,717,169 | A * | 9/1955 | Lindbloom | E05B 77/46 | 292/144 |
| 2,735,708 | A * | 2/1956 | Teed | E05B 77/52 | 292/182 |
| 2,885,239 | A * | 5/1959 | Young, Jr. | E05B 47/023 | 292/201 |
| 2,911,247 | A * | 11/1959 | Corbin | E05B 83/16 | 292/48 |
| 2,922,672 | A * | 1/1960 | Van Voorhees | E05B 81/20 | 292/11 |
| 2,926,943 | A * | 3/1960 | Leslie | E05B 83/16 | 292/53 |
| 2,992,032 | A * | 7/1961 | Griswold, Jr. | E05B 83/16 | 292/48 |
| 4,459,834 | A * | 7/1984 | Seki | E05B 53/00 | 292/336.3 |
| 4,505,500 | A * | 3/1985 | Utsumi | E05B 83/38 | 292/48 |
| 5,535,608 | A * | 7/1996 | Brin | E05B 13/002 | 292/DIG. 14 |
| 6,017,067 | A * | 1/2000 | Yoneyama | E05B 83/16 | 292/216 |
| 6,209,366 | B1 * | 4/2001 | Zagoroff | B62D 33/037 | 292/DIG. 3 |
| 6,808,213 | B2 * | 10/2004 | Heller | E05B 81/20 | 292/201 |
| 6,902,213 | B2 * | 6/2005 | Lee | E05B 81/06 | 292/216 |
| 7,559,585 | B2 * | 7/2009 | Plesternings | B60J 7/1851 | 292/201 |
| 8,152,217 | B2 * | 4/2012 | Tanoi | B60J 7/205 | 296/107.17 |
| 8,720,956 | B2 * | 5/2014 | Murray | E05B 79/20 | 292/48 |
| 2003/0052488 | A1 * | 3/2003 | Heller | E05B 79/20 | 292/63 |
| 2006/0001288 | A1 * | 1/2006 | Thiele | E05D 15/505 | 296/50 |
| 2008/0073915 | A1 * | 3/2008 | Hunt | E05B 81/06 | 292/201 |
| 2017/0096846 | A1 * | 4/2017 | Neely, III | E05B 7/00 | |
| 2018/0038139 | A1 * | 2/2018 | Zindler | B62D 25/12 | |
| 2019/0063119 | A1 * | 2/2019 | Sic | B60R 7/06 | |
| 2019/0092273 | A1 * | 3/2019 | Miller | E05B 83/24 | |
| 2019/0136584 | A1 * | 5/2019 | Emrich | E05B 79/20 | |
| 2019/0351952 | A1 * | 11/2019 | Hunt | E05B 81/14 | |
| 2020/0056407 | A1 * | 2/2020 | Kamiya | E05B 85/243 | |
| 2020/0071984 | A1 * | 3/2020 | Fukui | E05B 83/32 | |
| 2020/0080348 | A1 * | 3/2020 | Cappelli | E05B 81/64 | |

FOREIGN PATENT DOCUMENTS

| | | | |
|---|---|---|---|
| DE | 102006020344 | A1 | 10/2007 |
| DE | 102006026767 | A1 | 12/2007 |
| DE | 102007045227 | A1 | 2/2008 |
| DE | 10 2009 051 432 | A1 | 5/2011 |
| DE | 102009051432 | A1 | 5/2011 |
| DE | 20 2011 004952 | U1 | 7/2012 |
| EP | 1 857 621 | A2 | 11/2007 |
| WO | 2006/024264 | A1 | 3/2006 |

* cited by examiner

MOTOR VEHICLE DOOR LOCK

The invention relates to a motor vehicle door latch having a locking mechanism, with a catch and at least a pawl and an activation lever, whereby the locking mechanism can be unlocked at least directly by means of the activation lever and a lockinglocking device, whereby the activation lever can be disengaged with the locking mechanism by means of the lockinglocking device.

Motor vehicle door latches are used to latch doors, flaps or hoods in a motor vehicle. If it is customary, for example, for a door latch to be used on passenger vehicles, this changes when the size of the door exceeds a certain size, for example. In order to guarantee that large doors are also latched properly in every area of the door opening, it can be necessary to use two or more door latches for the proper latching of the door. For example, this could be the case if vehicles are equipped without a B-pillar and the doors are assigned a stabilizing function for the frame. Furthermore, for example, sliding doors can require a second motor vehicle door latch. Several door latches are preferably used if the door is very high. When using two or more door latches, it is customary to use a required number of secondary latches in addition to a primary latch Primary and secondary latches are arranged in such a way that sufficient closing force is available at every location on the door opening in order to maintain the door in its closed position, to stabilize the motor vehicle and to provide sufficient closing force in order to keep the door sealed against the door seal. If, for example, the door is moved in the area of the hinges in a situation-related manner when closing against the door seal profile and positioned in the area of the hinges so that sufficient sealing pressure is generated in order to seal the door, this force needs to be applied by the motor vehicle door latch or set against the door seal in order to also position the door in a sealing manner in this area. If the door is very high, for example, it may be necessary to use one, two or more secondary latches in addition to the primary latch in order to generate relevant positioning forces which seal the door circumferentially.

An example of a sliding door with a primary latch and a number of secondary latches is known from DE 10 2006 020 344 A1. The sliding door is revealed there as an example with a primary latch and a multitude of secondary latches. By means of a common control unit and separate transmitters, all latching systems, such as the primary latch and secondary latches can be acted on in order to activate and/or deactivate these. An activation of the latching systems occurs as usual, for example, by means of an external door handle or an internal door handle, but it can also occur in a contactless manner by means of a sensor. Starting from the activation devices, the latches can then be activated or deactivated and/or an impact can be had on the lockinglocking or closure functions.

A class-specific motor vehicle door latch is known from DE 10 2009 051 432 A1. The motor vehicle door latch demonstrates a locking mechanism consisting of a catch and at least a pawl, whereby the catch can be engaged with a latch holder and the pawl ratchets the locking mechanism in the closed state of the door. In order to open the ratcheted locking mechanism, a coupling lever is connected to the pawl by means of a pin so that with a suitable alignment of the coupling lever and an activation of the coupling lever it can be activated in this example by means of an activation lever so that the locking mechanism can be unlocked. The coupling lever serves as a coupling between the pawl and the activation lever.

In addition to the triggering, i.e. the unlocking of the locking mechanism, the coupling lever is assigned a further function. According to the position of the coupling lever, an activation of the triggering or activation lever can be made ineffective, i.e. the motor vehicle door latch is bolted. In order to bolt the motor vehicle door latch, an external ratcheting lever, an internal ratcheting lever or an electrical drive can be used. All three lockinglocking mechanisms act on a lockinglocking lever which in turn engages with the coupling lever and can engage or disengage the coupling lever from the triggering or activation lever.

If sliding doors or lateral doors, of transporters, for example, are equipped with above-average height with a primary latch and a secondary latch, the primary and secondary latch are thus present in the door at a distance from one another. A problem which arises from such latch combinations of primary and secondary latch is that in order to open both latches only an activation lever is available, such as an internal door handle or an external door handle. The opening stroke of the external and internal door handle must then be used to unlock both latches. It must hereby be heeded that the available activation path of the internal or external handle involves the present tolerances and the tolerances to be expected, the distances to be bridged between the latches and the triggering forces occurring or required in the motor vehicle door latches. The triggering forces of the secondary latch are thus added to the triggering forces of the primary latch so that a multitude of requirements are placed on a mechanical connection of a secondary latch on a primary latch.

Although the known latching systems comprising a primary latch and a secondary latch can execute advanced functions, such as lockinglocking and unlockinglocking and, for example, a convenience function can be executed in the primary latch, these functions are also required in the secondary or additional latches. Separate components and devices therefore need to be provided for in the secondary latches to this end. It is vital to overcome this disadvantage according to the present invention.

The invention is based on the task of improving a motor vehicle door latch in such a way that an additional latch connected to the motor vehicle door latch is also equipped with advanced functions and in particular a convenience function. A further task of the invention is to provide a cost-effective connection of a simple construction for an additional latch which encompasses advanced lockinglocking and convenience functions.

The task is solved according to the invention by the characteristics of the independent claims. Advantageous designs of the invention are specified in the sub-claims. It is pointed out that the embodiment examples described hereafter are not restrictive; instead, any possible variations are possible of the characteristics described in the description and the sub-claims.

According to patent claim 1 the task of the invention is solved in such a way that a motor vehicle door latch is provided having a locking mechanism, with a catch and at least a pawl and an activation lever, whereby the locking mechanism can at least be indirectly unlocked by means of the activation lever and a lockinglocking device, whereby the activation lever can be disengaged from the locking mechanism by means of the lockinglocking device, and whereby a further motor vehicle door latch is provided for and which by means of the activation lever the further motor vehicle door latch can be activated and that by means of the lockinglocking device the activation lever chain can be disengaged from the further motor vehicle latch. According to the invention, the possibility is now given of jointly lockinglocking a motor vehicle door latch and a further motor vehicle door latch, in particular an additional latch. The activation lever chain is disengaged from the activation lever by means of the lockinglocking device present in the primary latch so that activation of the activation lever does not unlock the locking mechanism of the primary latch and also the secondary latch. If the lockinglocking device disengages the activation lever from the locking mechanism, according to the invention the lockinglocking lever can simultaneously disrupt the activation lever chain to the additional latch so that a bolted state can be attained for the primary latch and the secondary latch.

If a locking mechanism is spoken of in for the purpose of the invention, this hereby encompasses a catch which is preferably pivotably accommodated in the motor vehicle door latch and can preferably be engaged with a latch holder. If the catch is engaged with the latch holder, the at least one pawl can thus fix the catch in its position so that the locking mechanism is locked. The locked locking mechanism can be unlocked by means of the activation lever, preferably by means of a triggering lever interacting with the activation lever and/or a coupling lever. The lockinglocking device hereby disrupts the activation lever chain to the locking mechanism. According to the invention, the further motor vehicle door latch, in particular the additional latch, can also be unlocked by means of the activation lever. The additional latch is preferably also a motor vehicle door latch which is equipped at least with a locking mechanism and an activation lever. If the activation lever of the primary latch is now disengaged from the activation lever chain, this hereby also prevents unlocking of the locking mechanism of the additional latch. The additional latch and primary latch are bolted.

In one embodiment of the invention, a second activation lever is provided for on the motor vehicle door latch, whereby the second activation lever can be activated by means of the first activation lever and the further motor vehicle door latch can be activated by means of the second activation lever. If work takes place with a second activation lever, the possibility exists of not only disrupting the activation lever chain in relation to the first activation lever, but the lockinglocking device also has the possibility of engaging into the activation lever chain between the first and second activation lever. An especially cost-effective solution of a simple construction can thus be executed for disengagement of the first activation lever or disruption of the activation lever chain.

The second activation lever can preferably be arranged in a bearing point present in the primary latch so that no additional components are required for the incorporation of the second activation lever. The second activation lever can preferably be accommodated on an axis of the lockinglocking lever. Yet more preferably, the axis for the second activation lever and the lockinglocking lever also accommodates a locking mechanism component, in particular the catch. The joint incorporation of several components of the primary latch can provide an extremely cost-effective execution of a lockinglocking device for the primary and secondary latches.

If the first and second activation levers are connected by means of a coupling lever, a further embodiment of the invention thus results. Use of a coupling lever between the first and second activation lever hereby enables the lockinglocking device in its original construction or with only very slight modifications to be executed and it can only have an extension, for example, so that the coupling lever can be disengaged with the second activation lever or alternatively with the first activation lever and can thus provide a lockinglocking function for the secondary latch. Use of available components or largely available components offers the advantage that recourse can be had to proven functions and a proven interplay between the components of the motor vehicle door latch and only the connection of the additional latch and the advanced function of a lockinglocking needs to be integrated into the primary latch.

It is also advantageous and a further embodiment if the lockinglocking device has at least a pivotably accommodated lockinglocking lever. By means of the use of a pivotably accommodated lockinglocking lever the possibility exists of using angular movements for a lockinglocking function. This offers an advantage in particular if, for example, spring forces or loads need to be overcome from the activation chain, then by means of a relevant selection of the lever ratios of the lockinglocking lever in interplay with the locking or unlocking an impact can be had on the force to be generated. Furthermore, rotational movements in the motor vehicle door latch are easy to achieve and can, for example, can be simply executed and produced by means of a wormgear and a gearwheel interacting with the wormgear.

A pivotably accommodated lockinglocking lever also offers the possibility that both an electromotorized drive and a further lockinglocking lever, such as an internal lockinglocking and an external lockinglocking can act on the lockinglocking lever. For example, the locking lever can be executed disk-shaped. In different places on the disk, different triggering or activation levers can act on the locking lever. Furthermore, end stops or restrictions can also be easily arranged as a disk-shaped construction enables a large number of engagement points on the locking lever.

A further embodiment of the invention results if by means of the locking lever the first activation lever can be disengaged from a triggering lever and the coupling lever can be disengaged from the second activation lever. If, by means of the locking lever, the first activation lever and the coupling lever are disengaged for activation of the second activation lever, with only one movement, preferably an angular movement or rotation of the locking lever, the primary latch and secondary latch can be bolted. This offers the advantage that locking or unlocking is easy to achieve and furthermore the locking function can be provided quickly. Furthermore, only one means is necessary to activate the locking lever in order to bolt or unbolt the primary and secondary latches. An internal locking lever, an external locking lever or, for example, an electrical drive can be used as activation means which all act on the locking lever, locking or unlocking can be triggered. By using the locking lever as a means for locking and unlocking for the primary and secondary latch. in turn the number of required components can be kept low which, in turn, has a positive effect on manufacturing costs and the construction.

If the coupling lever is connected to the second activation lever in a form-fitting and detachable manner, a further embodiment of the invention results. A form-fitting and/or detachable connection between the second activation lever and the coupling lever offers the possibility of being able to execute both a secure connection between the coupling lever and the second activation lever and also offers the possibility of being able to design locking and unlocking as a cost-effective construction. With an exclusive form-fitting connection between the second activation lever and the coupling lever, for example, a contour can be formed on the coupling lever which enables or prevents engagement of the second activation lever dependent on the position of the coupling lever. With a detachable connection, the coupling lever can, for example, be disengaged from the second activation lever by means of a pivoting movement. Naturally, within the scope of the invention, combined form-fitting and detachable connections between the coupling lever and the second activation lever are also conceivable.

An advantageous connection between the locking lever and the coupling lever results when the coupling lever has an extension and the extension engages with the locking lever so that a movement of the locking lever can be transferred to the coupling lever. An extension which engages, for example, in a form-fitting manner into the present locking lever offers the advantage that the least possible changes to absolutely no changes need to be undertaken on the locking lever in order to enable interplay between the coupling lever and the locking lever. If, for example, a form-fitting connection is present between the shape formed on the extension and the coupling lever, engagement can take place, for example, into a present contour of the locking lever in order to execute locking and unlocking of the secondary latch. For example, an extension can be executed from a cylinder pin engaging into the locking lever. Naturally, within the scope of the invention an interplay from a contour formed on the locking lever and an extension or recess in the coupling lever is conceivable.

An especially advantageous embodiment of the invention results if the extension interacts elastically with the locking lever. If a locking and unlocking function can be executed according to the previously described embodiment examples by means of a suitable formation of a coupling lever to the secondary latch or additional latch, an elastic connection between the locking lever and the coupling lever gives the possibility of providing a convenience function of an additional latch.

A convenience function hereby means that in the case in which the motor vehicle latch is bolted, i.e. the activation chain is disrupted, so that the activation lever is disengaged with the locking mechanism, and at the same time, for example, by means of the electrical drive or a manual internal locking activates the locking lever, thus the unlocking can be stored by means of the elastic connection between the coupling lever and the locking lever. If, for example, the external activation lever, i.e. the first activation lever is pulled and the coupling lever is disengaged from the second activation lever and if at the same time the locking lever is moved into the unbolted position, the elastic connection between the coupling lever and the locking lever is deformed and stores the unlocking position by means of the deformation energy.

If the external activation lever, i.e. the first activation lever, is now moved back into its starting position, the coupling lever is engaged again with the second activation lever. The elastically deformed extension or connection between the coupling lever and the locking lever acts in such a way that the coupling lever is moved back into its unbolted position. A convenience function can thus be executed for the additional latch with the simplest constructional means.

If the extension is formed of a single component with the coupling lever, a further advantageous embodiment thus results for execution of the convenience functions. A single-component formation of the extension offers the advantage that only one component needs to be manufactured and installation times and costs cease to apply. The coupling lever and the plastic extension are preferably manufactured as a single component as a plastic injection-molded component. Plastics also offer high permanent elasticity and with the large number of available plastics they also offer a suitable selection in order to transfer activation forces to unlock the locking mechanism of the primary and secondary latches.

It can also be advantageous if, in one embodiment, the extension is formed of a spring leg of a spring. If, for example, a leg spring is firmly connected to the coupling lever, a spring arm can also be executed in interplay with the locking lever in order to execute a convenience function. Advantageously, a cost-effective solution can thus be provided for a convenience function. In particular, the motor vehicle door latch can be configured individually. If, for example, a motor vehicle user does not desire a convenience function, an individual adaptation can very easily be executed by the omission of the spring. Due to the construction according to the invention and the use of a coupling lever, the unlocking and convenience function can thus be provided for an additional latch with the simplest constructional means and without significant changes in the primary latch for an additional latch.

The invention is described in further detail below with reference to the attached drawings on the basis of the preferred embodiments. However, the principle applies that the embodiment example does not restrict the invention but only constitutes an advantageous embodiment. The characteristics depicted can be executed individually or in combination, individually or in combination with other characteristics of the description, as also the patent claims.

Figure 2:
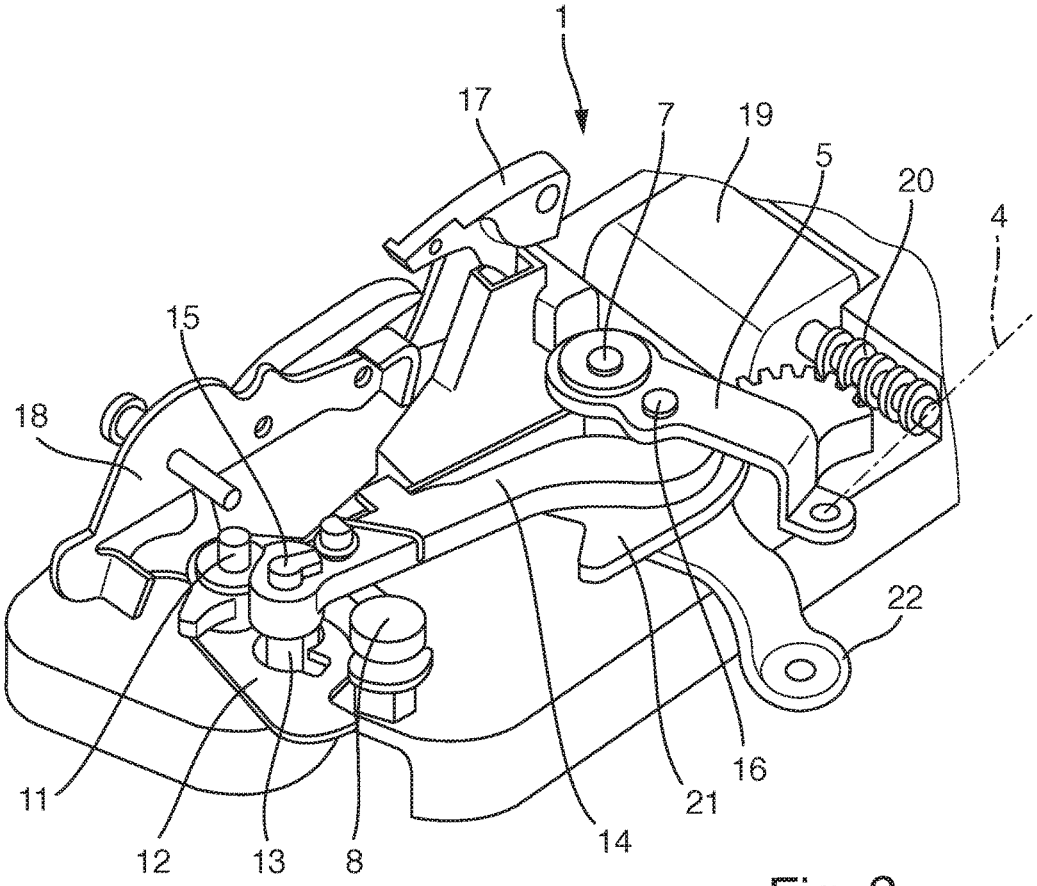
Figure 3:
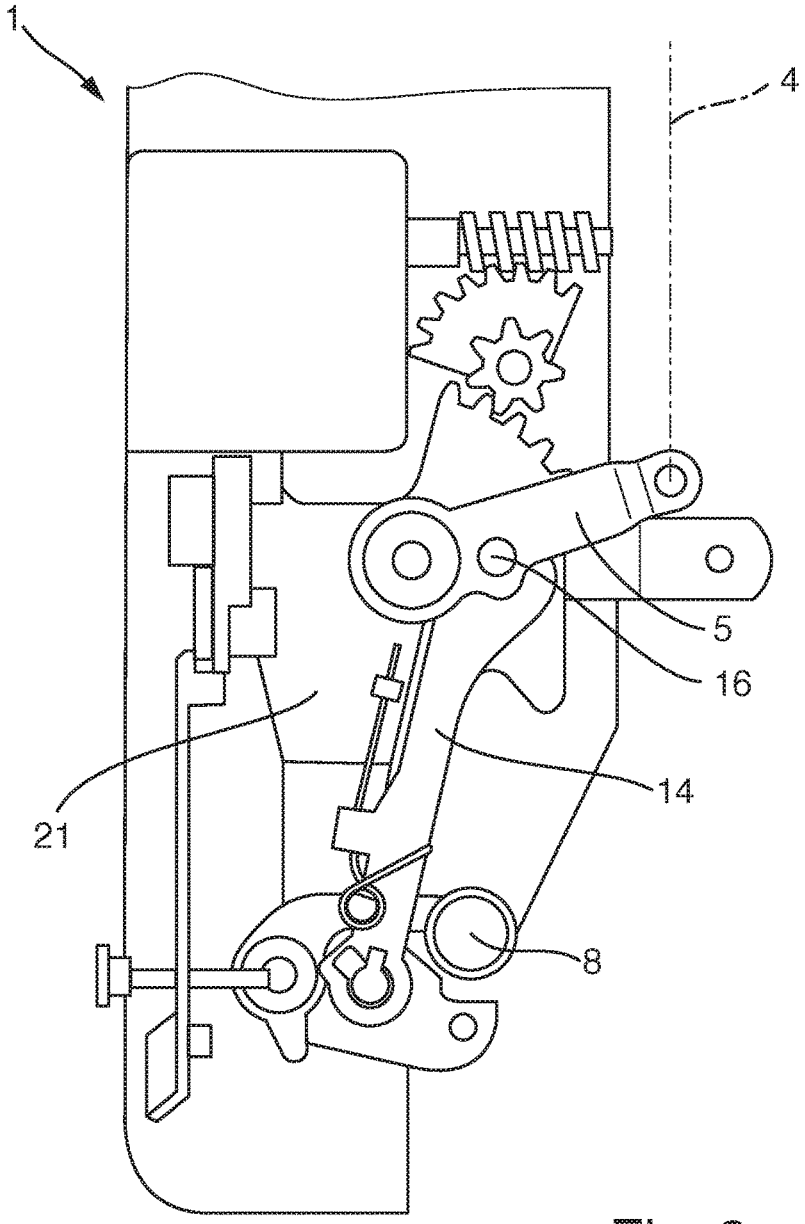
Figure 4:
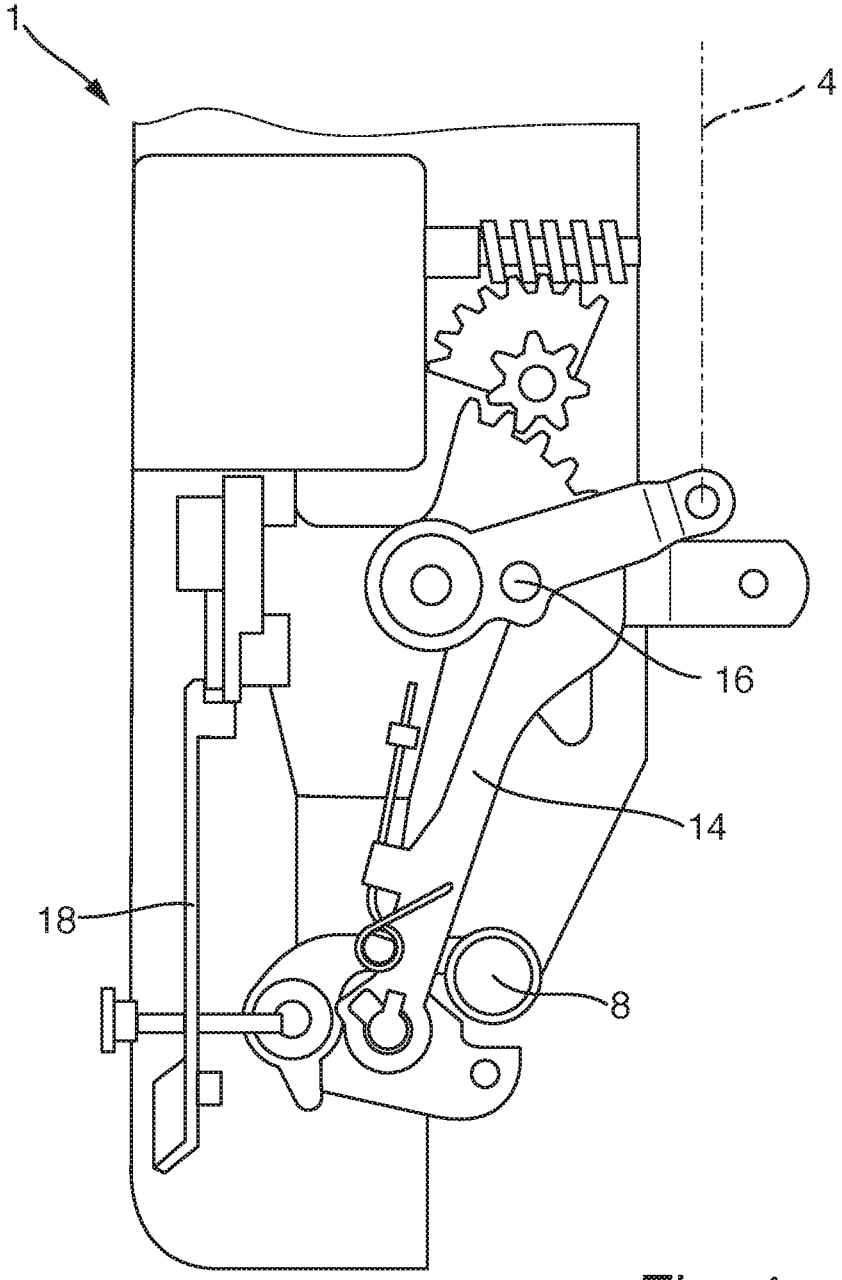
Figure 5:
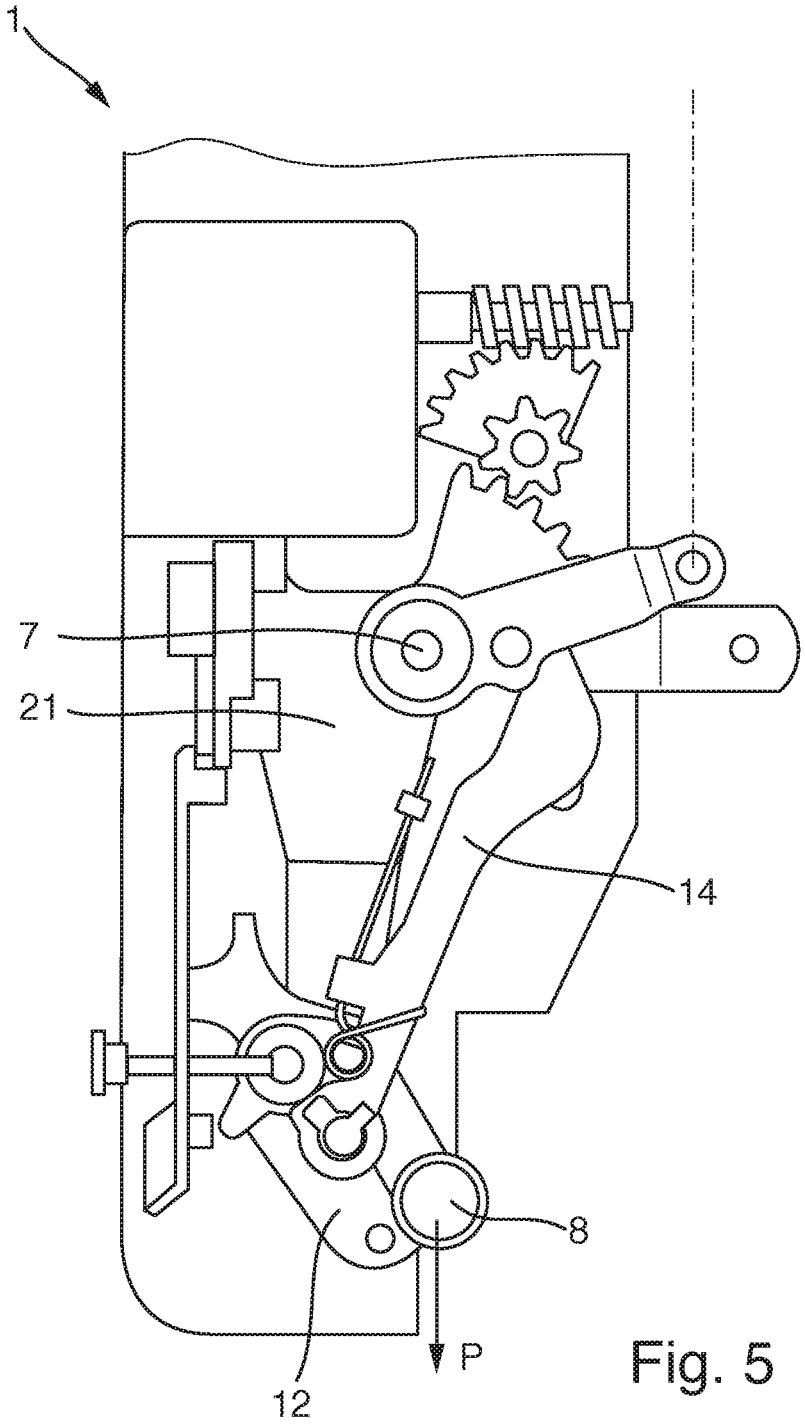
Figure 6:
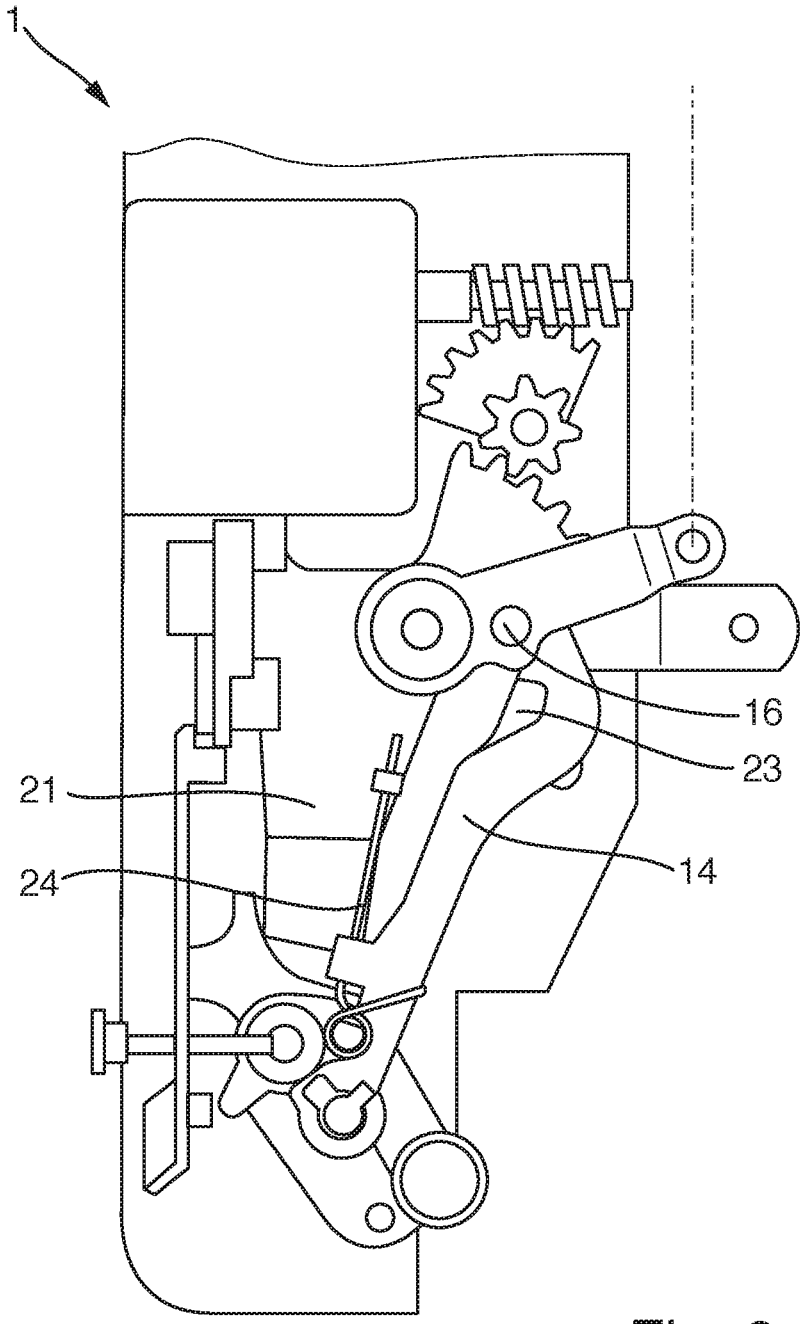
Figure 7:
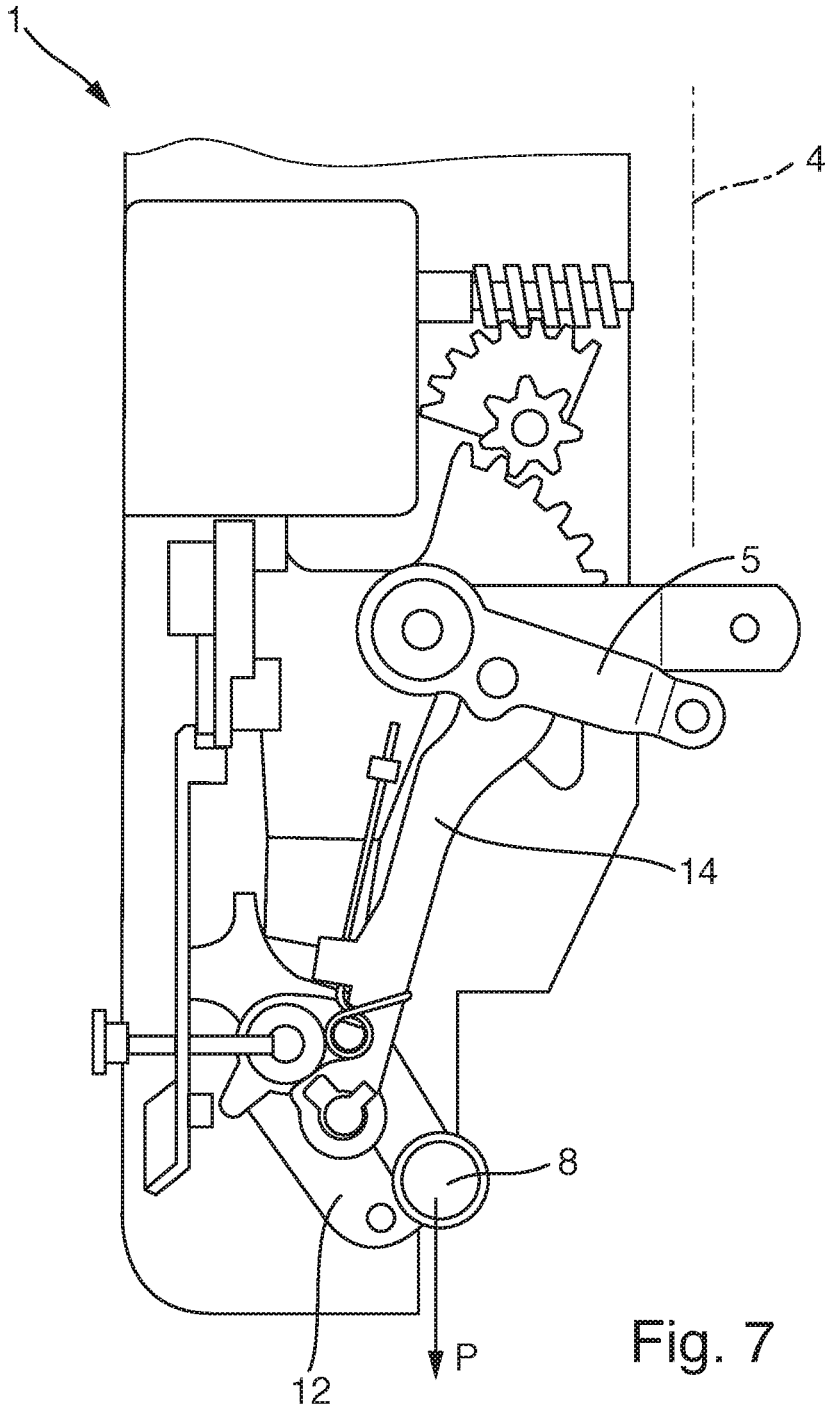
Figure 8:
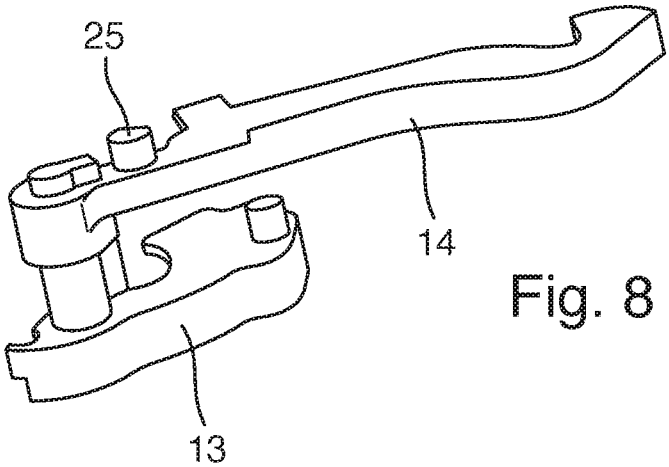
Figure 9:
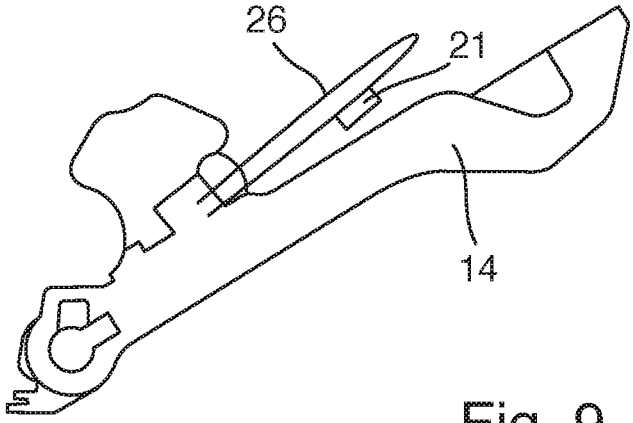

The following are shown:

FIG. 1 a three-dimensional view of an arrangement of a motor vehicle door latch and a theoretical position of an additional latch in an arrangement which serves as an example in a sliding door, with an indicated connection between the motor vehicle door latch and the additional latch, FIG. 2 a three-dimensional view onto a motor vehicle door latch according to FIG. 1, whereby the motor vehicle door latch is depicted without a housing lid and only with the constructional elements explaining the invention, FIG. 3 a lateral view of the opened motor vehicle latch according to FIG. 2 in a functional position unactivated and unbolted, FIG. 4 a lateral view of the motor vehicle latch according to FIG. 2 in the functional position unactivated and bolted, FIG. 5 a lateral view of a motor vehicle latch according to FIG. 2 in the functional position of the first activation lever activated and bolted, FIG. 6 a lateral view of a motor vehicle latch according to FIG. 2 in the functional position of the first activation lever activated and unbolted, whereby a convenience function is illustrated in this figure, FIG. 7 a lateral view of a motor vehicle latch according to FIG. 2 in a functional position of the first and second activation lever activated and primary and secondary latch unbolted, FIG. 8 a three-dimensional view of the accommodation of the coupling lever with an accommodation of the coupling lever in the motor vehicle latch serving as an example, and FIG. 9 a top view of a coupling lever according to the invention with an arranged bearing point in the motor vehicle door latch.

FIG. 1 shows a three-dimensional view of a motor vehicle door latch 1 in a theoretical position to a further motor vehicle door latch 2 in a theoretically depicted sliding door 3. In this arrangement, the motor vehicle door latch 1 forms the primary latch; in contrast, the further motor vehicle door latch 2 forms the secondary latch 2. The secondary latch 2 can also be described as an additional latch 2. A mechanical connection is theoretically depicted between the primary latch 1 and the additional latch 2 which can be a Bowden cable 4 for example. The Bowden cable 4 connects the second activation lever 5 to the triggering and/or activation lever 6 on the additional latch 2. The second activation lever 5 is pivotably accommodated in the primary latch 1 by means of the axis 7. A first activation lever 8 is only apparent in places here as the first activation lever 8 is concealed by the housing lid 9. The first activation lever 8 can also be activated by means of a Bowden cable, for example, whereby the Bowden cable is not illustrated, but can be inserted and fixed into the mounting 10 of the housing lid 9 for example.

In FIG. 2, the motor vehicle door latch or the primary latch 1 according to FIG. 1 is illustrated in a three-dimensional view but without a housing lid 9. Furthermore, only the components of the motor vehicle door latch 1 were illustrated which are significant in explaining the function of the invention. The same components are furnished with the same reference figures.

The first activation lever 8 is pivotably accommodated in the axis 11. A triggering lever 12 is arranged below the first activation lever 8 which is also accommodated on the axis 11. On activation of the first activation lever, the external activation lever 8 is moved against the triggering lever 12 so that an unrecognizable locking mechanism can be unlocked by means of a first coupling lever 13. The second coupling lever 14 is pivotably accommodated on the first coupling lever 13 and in particular on an extension 15 of the first coupling lever 13. The coupling lever 14 engages into the graded mandrel 16 on the second activation lever 5 in a form-fitting and detachable manner. The activation lever chain for activation of the secondary latch or additional latch 2 therefore takes place according to the illustrated embodiment example by means of the first activation lever 8, the triggering lever 12, the first coupling lever 13, the second coupling lever 14, the graded mandrel 16, the second activation lever 5 and the Bowden cable 4.

An internal locking lever 17, an internal activation lever 18 and an electrical drive 19, with a wormgear 20 are also apparent. The locking lever 21 can be electrically activated by means of the electrical drive and the wormgear. The locking lever can also be pivoted by means of the internal locking lever 17 and an external locking lever 22.

In the following FIGS. 3 to 7, the function of the primary latch 1 should be explained in interplay with the additional latch 2 and the functionalities resulting from the invention. In FIG. 3, the lateral view of the primary latch 1 is reproduced in a lateral view according to FIG. 2 without a housing lid 9. The state of the latch is illustrated in which the primary latch 1 is neither activated nor bolted. The first activation lever 8 is located in its starting position and the second coupling lever 14 engages into the graded mandrel 16 so that a mechanical connection is guaranteed between the first activation lever 8 and the second activation lever 5. All components such as also the locking lever 21 are located in a position in which the primary latch 1 and the additional latch 2 could be unlocked by means of an external door handle or an internal door handle, if these are activated.

In FIG. 4 the primary latch 1 is reproduced in turn in a lateral view according to FIG. 2 without a housing lid 9, whereby the also unactivated state is shown here; however, the primary latch 1 is present in the bolted state. Unactivated means that neither the internal activation lever nor the external activation lever or the first activation lever 8 are activated. The bolted state also means that the first coupling lever 13 is disengaged from the locking mechanism and that the second coupling lever 14 was pivoted around an angle in a clockwise direction so that the second coupling lever 14 is disengaged from the graded mandrel 16. Activation of the internal or external activation lever 8, 18 would consequently not lead to unlocking of the main latch 1 and the additional latch 2 as both the first coupling lever 13 and the second coupling lever 14 are disengaged.

In FIG. 5, in turn, a lateral view on the primary latch 1 is reproduced according to FIG. 2 without a housing lid 9, whereby the activated and bolted state is illustrated. According to FIG. 4, the primary latch 1 was present in the bolted state so that the first and second coupling levers 13, 14 were disengaged. In FIG. 5 the external activation lever or first activation lever 8 was pivoted in the direction of the arrow P. The consequence of pivoting of the first activation lever 8 is that the triggering lever 12 and also the second coupling lever 14 are also moved in the direction of the arrow P. However, as the bolted state is present, the movement of the first activation lever 8 has no effect on the primary latch 1 and the additional latch 2, so that an operator who pulls the external door handle cannot open the door.

In order to bolt the primary latch 1 and the secondary latch 2 the external locking lever 22 was pivoted around the axis 7 so that both the second coupling lever 14 and also the first coupling lever 13 were disengaged.

In FIG. 6, the embodiment of a convenience function according to the invention is now reproduced for the additional latch 2. If the primary latch 1 is electrically unbolted, for example, in the state according to FIG. 5, in which the first activation lever was activated, the locking lever 21 thus moves in a clockwise direction into the position illustrated in FIG. 6. However, the second coupling lever 14 cannot engage into the graded mandrel 16 as the contour 23 which engages into the graded mandrel 16 is located below the graded mandrel 16. In this case, the spring 24 pre-tensions the second coupling lever 14 so that the "Unbolted" function is saved. Saving of the "Unlocking" function constitutes the convenience function. If the second coupling lever reverts to its starting position after release of the external door handle, for example, the spring force of the spring 24 causes the contour 23 to engage with the graded mandrel 16 without requiring a further action by an operator. The "Unbolted" function is assumed independently so that with repeated activation of the external door handle the locking mechanisms of the primary latch 1 and the secondary latch 2 are unlocked.

In FIG. 7, in turn, the lateral door latch or primary latch is reproduced according to FIG. 2 without a housing lid 9, namely in the activated and unbolted state. In the embodiment example, in turn, the external activation lever or the first activation lever 8 is pulled in the direction of the arrow P, whereby the triggering lever 12 is moved and the locking mechanism of the primary latch 1 is unlocked. Furthermore, the second activation lever 5 is pivoted by means of the coupling lever 14 so that by means of a movement of a Bowden cable 4, for example, the additional latch 2 can also be unlocked.

In FIG. 8, the second coupling lever 14 is reproduced in relation to accommodation on the first coupling lever 13. A dual component construction is illustrated consisting of a first and second coupling lever 13, 14; however, it is also conceivable to execute the first and second coupling levers 13, 14 as a single-component construction. If the spring 24 is accommodated on the elevation 25 for storage of the convenience function and engages into the locking lever 21 with the long spring leg, so that a relative force can be executed between the coupling lever 14 and the locking lever 21, it is also conceivable to mold a spring arm 26 to the second coupling lever 14 as a single component, whereby the spring arm 26 assumes the convenience function and interacts with the locking lever 21 for storage of the convenience function.

Formation of the second coupling lever 14 with a spring arm 26 is reproduced as an example in FIG. 9.

LIST OF REFERENCE SYMBOLS

1 Motor vehicle door latch, primary latch, lateral door latch
2 Further motor vehicle door latch, secondary latch, additional latch
3 Sliding door
4 mechanical connection, Bowden cable
5 second activation lever
6 triggering and/or activation lever on the additional latch
7 axis
8 first activation lever
9 housing lid
10 mounting
11 axis, first activation lever
12 triggering lever
13 first coupling lever
14 second coupling lever
15 extension
16 graded mandrel
17 internal locking lever
18 internal activation lever
19 electrical drive
20 wormgear
21 locking lever
22 external locking lever
23 contour
24 spring
25 mounting
26 spring arm
P arrow

The invention claimed is:

1. A motor vehicle door latch assembly comprising:

a primary motor vehicle door latch having a first housing containing a first locking mechanism with a catch and at least a pawl, and a first activation lever configured to unlock the first locking mechanism;

a secondary motor vehicle door latch having a second housing arranged remotely relative to the primary motor vehicle door latch and having a second locking mechanism, wherein the first housing of the primary motor vehicle door latch contains a locking device configured to both disengage the first activation lever from the first locking mechanism, and the first activation lever from the secondary motor vehicle door latch, wherein the primary motor vehicle door latch includes a second activation lever mounted directly to the first housing, the second activation lever being configured to be activated by the first activation lever and configured to activate the second locking mechanism, wherein the first activation lever and the second activation lever are connected by a coupling lever, and an elastic connection that is formed as an extension of the coupling lever and configured to directly engage the locking device, wherein movement of the locking device is transmitted to the coupling lever via the elastic connection;

wherein the elastic connection is formed as a spring leg of a spring.

2. The motor vehicle door latch assembly according to claim 1, wherein the locking device has at least a pivotably accommodated locking lever.

3. The motor vehicle door latch assembly according to claim 2, wherein the locking lever is configured to disengage the first activation lever from a triggering lever, and the coupling lever from the second activation lever.

4. The motor vehicle door latch assembly according to claim 1, wherein the coupling lever is connected to the second activation lever in a form-fitting and/or detachable manner.

5. The motor vehicle door latch assembly according to claim 1, wherein the spring leg directly engages the coupling lever.

6. The motor vehicle door latch assembly according to claim 1, wherein the spring leg is elongated along an elongated length of the coupling lever.

7. The motor vehicle door latch assembly according to claim 1, wherein the spring leg extends in a direction that is parallel to a direction in which an elongated length of the coupling lever extends.

* * * * *